US005405043A

United States Patent [19]

Meloney

[11] Patent Number: 5,405,043

[45] Date of Patent: Apr. 11, 1995

[54] DOOR MOUNTED HAMPER

[76] Inventor: Donald W. Meloney, 1102 Oakwood Dr., Glenolden, Pa. 19036

[21] Appl. No.: 160,268

[22] Filed: Dec. 2, 1993

[51] Int. Cl.[6] ..... B65H 1/08

[52] U.S. Cl. ..... 220/578; 221/279; 221/283; 211/88; 220/481; 220/529

[58] Field of Search ..... 221/283, 282, 279; 220/578, 476, 480, 629, 529, 481, 482, 242, 307, 241; 248/682, 311.2; 211/88

[56] References Cited

U.S. PATENT DOCUMENTS

| | | | |
|---|---|---|---|
| 1,207,092 | 12/1916 | Sullivan | 221/283 |
| 1,228,098 | 5/1917 | Cole | 248/311.2 |
| 1,615,968 | 2/1927 | Wakefield | 220/482 |
| 1,621,536 | 3/1929 | Handte | 220/480 |
| 2,203,067 | 6/1940 | Theis | 221/283 |
| 2,277,737 | 3/1942 | Wilkinson | 220/481 |
| 2,277,738 | 3/1942 | Wilkinson | 248/311.2 |
| 2,313,944 | 3/1943 | Keener et al. | 248/311.2 |
| 2,878,955 | 3/1959 | Hagan | 220/476 |
| 4,094,416 | 6/1978 | Smith | 211/88 |
| 4,484,692 | 11/1984 | Palermo et al. | 220/476 |
| 5,088,620 | 2/1992 | Kelliher et al. | 221/279 |
| 5,098,108 | 3/1992 | McKinney | 273/400 |

*Primary Examiner*—Stephen J. Castellano
*Attorney, Agent, or Firm*—Michael J. Colitz, Jr.

[57] ABSTRACT

A hamper attachable to a back of a door for receiving laundry. The hamper is dimensioned to fit between the door and an adjoining wall when the door is in an open position and includes a receptacle structure in which the front panel may take the form of either a rigid panel or a deformable fabric panel. A spring supported movable wall for ejecting laundry from the hamper is disclosed and an alternate embodiment of the present invention includes a deodorant dispenser for spraying a mist of sanitary fluid onto the associated laundry.

2 Claims, 4 Drawing Sheets

DOOR MOUNTED HAMPER

BACKGROUND OF THE INVENTION

1. Field of the Invention

The present invention relates to receptacles and more particularly pertains to a hamper attachable to a back of a door for receiving laundry.

2. Description of the Prior Art

The use of receptacles is known in the prior art. More specifically, receptacles heretofore devised and utilized for the purpose of containing articles of clothing are known to consist basically of familiar, expected and obvious structural configurations, notwithstanding the myriad of designs encompassed by the crowded prior art which have been developed for the fulfillment of countless objectives and requirements.

For example, a clothes hamper is illustrated in U.S. Pat. No. 5,098,108 which includes a backboard configured and decorated to resemble a basketball backboard. Brackets support the backboard at the top end of a door and a hoop configured to resemble a basketball goal is supported on the backboard. The hoop, in turn, supports a mesh clothes receiving net that extends vertically downwardly therefrom. The lower end of the mesh net is normally closed by a draw string such that clothes may be received within the net for temporary storage.

A hamper is described in U.S. Pat. No. 4,218,103 for collecting items such as soiled laundry which includes a cylindrical receptacle wall having a reception entrance at the top and a delivery port at the side. The delivery port may be selectively opened or closed by a cylindrical sleeve which overlies the receptacle wall and can be rotated relative thereto. A liner may be placed within the cylindrical receptacle and, upon being filled with the items placed therein, removed through the delivery port such that the items are neatly contained within the liner.

Another patent of interest is U.S. Pat. No. 4,057,309 which discloses a clothes hamper having a plurality of upper compartments mounted above a partition shelf, and a plurality of lower compartments mounted in the hamper below the partition for movement into and out of the hamper through a front wall opening, such that the associated laundry may be appropriately segregated for subsequent washing thereof.

Other known receptacles include U.S. Pat. No. 4,739,880, and Design U.S. Pat. No. 309,808.

While these devices fulfill their respective, particular objectives and requirements, the aforementioned patents do not disclose a hamper attachable to a back of a door for receiving laundry that is dimensioned to fit between the door and an adjoining wall when the door is in an open position which includes a receptacle structure in which the front panel may take the form of either a rigid panel or a deformable fabric panel. Furthermore, none of the known prior art receptacles teach or suggest a spring supported movable wall for ejecting laundry from the hamper and a deodorant dispenser for spraying a mist of sanitary fluid onto the associated laundry.

In these respects, the door mounted hamper according to the present invention substantially departs from the conventional concepts and designs of the prior art, and in so doing provides an apparatus primarily developed for the purpose of receiving and containing laundry.

SUMMARY OF THE INVENTION

In view of the foregoing disadvantages inherent in the known types of receptacles now present in the prior art, the present invention provides a new door mounted hamper construction wherein the same can be utilized for receiving and containing laundry. As such, the general purpose of the present invention, which will be described subsequently in greater detail, is to provide a new door mounted hamper apparatus which has many of the advantages of the receptacles mentioned heretofore and many novel features that result in a door mounted hamper which is not anticipated, rendered obvious, suggested, or even implied by any of the prior art receptacles, either alone or in any combination thereof.

To attain this, the present invention essentially comprises a hamper attachable to a back of a door for receiving laundry. The hamper is dimensioned to fit between the door and an adjoining wall when the door is in an open position and includes a receptacle structure in which the front panel may take the form of either a rigid panel or a deformable fabric panel. A spring supported movable wall for ejecting laundry from the hamper is disclosed and an alternate embodiment of the present invention includes a deodorant dispenser for spraying a mist of sanitary fluid onto the associated laundry.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new door mounted hamper apparatus which has many of the advantages of the receptacles mentioned heretofore and many novel features that result in a door mounted hamper which is not anticipated, rendered obvious, suggested, or even implied by any of the prior art receptacles, either alone or in any combination thereof.

It is another object of the present invention to provide a new door mounted hamper which may be easily and efficiently manufactured and marketed.

It is a further object of the present invention to provide a new door mounted hamper which is of a durable and reliable construction.

An even further object of the present invention is to provide a new door mounted hamper which is susceptible of a low cost of manufacture with regard to both materials and labor, and which accordingly is then susceptible of low prices of sale to the consuming public, thereby making such door mounted hampers economically available to the buying public.

Still yet another object of the present invention is to provide a new door mounted hamper which provides in the apparatuses and methods of the prior art some of the advantages thereof, while simultaneously overcoming some of the disadvantages normally associated therewith.

Still another object of the present invention is to provide a new door mounted hamper attachable to a back of a door for receiving laundry.

Yet another object of the present invention is to provide a new door mounted hamper which is dimensioned to fit between a door and an adjoining wall when the door is in an open position.

Even still another object of the present invention is to provide a new door mounted hamper that includes a receptacle structure in which the front panel thereof may take the form of either a rigid panel or a deformable fabric panel.

Even still yet another object of the present invention is to provide new door mounted hamper which includes a spring supported movable wall for selectively ejecting laundry from the hamper.

Even still yet another further object of the present invention is to provide a new door mounted hamper which includes a deodorant dispenser for spraying a mist of a sanitary fluid onto the associated laundry.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
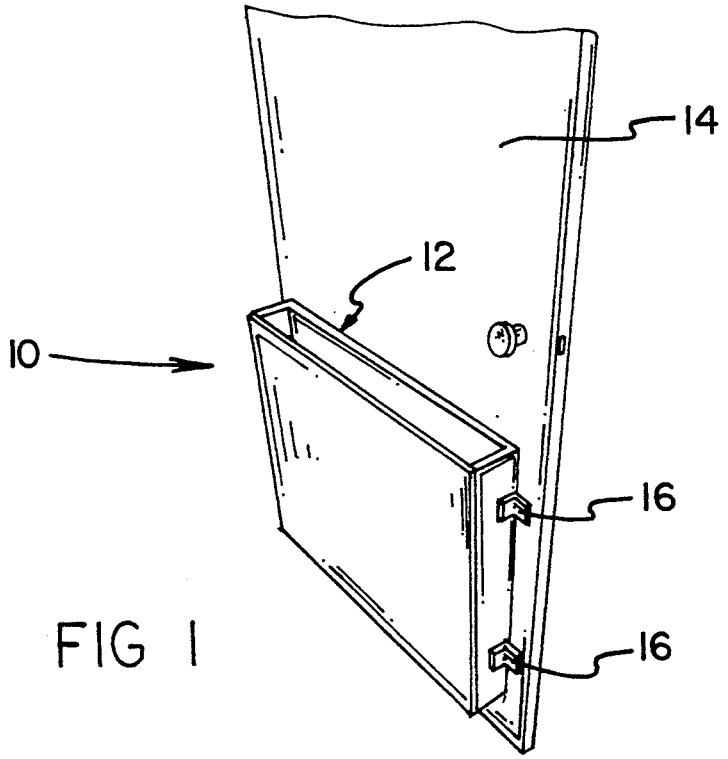
FIG. 1 is a perspective view of a first embodiment of a door mounted hamper comprising the present invention.

With reference now to the drawings, and in particular to FIGS. 1–4 thereof, a first embodiment of a new door mounted hamper embodying the principles and concepts of the present invention and generally designated by the reference numeral 10 will be described.

From an overview standpoint, the door mounted hamper 10 comprises a receptacle 12 having a substantially rectangular horizontal cross section which may be attached to a backside of a door 14 by a plurality of brackets 16 and appropriate screws 18, as best illustrated in FIG. 1. The receptacle 12 is dimensioned to fit between the door and an adjoining wall when the door is in an open position. The receptacle 12 is open at its upper most end, whereby soiled laundry or other items may be placed therewithin.

In use, the door mounted hamper 10 provides a convenient means for receiving and containing laundry which is inconspicuously mounted behind the door 14. Through this arrangement, the door mounted hamper 10 is effectively hidden behind the door when the door is in an open position.

Figure 4:
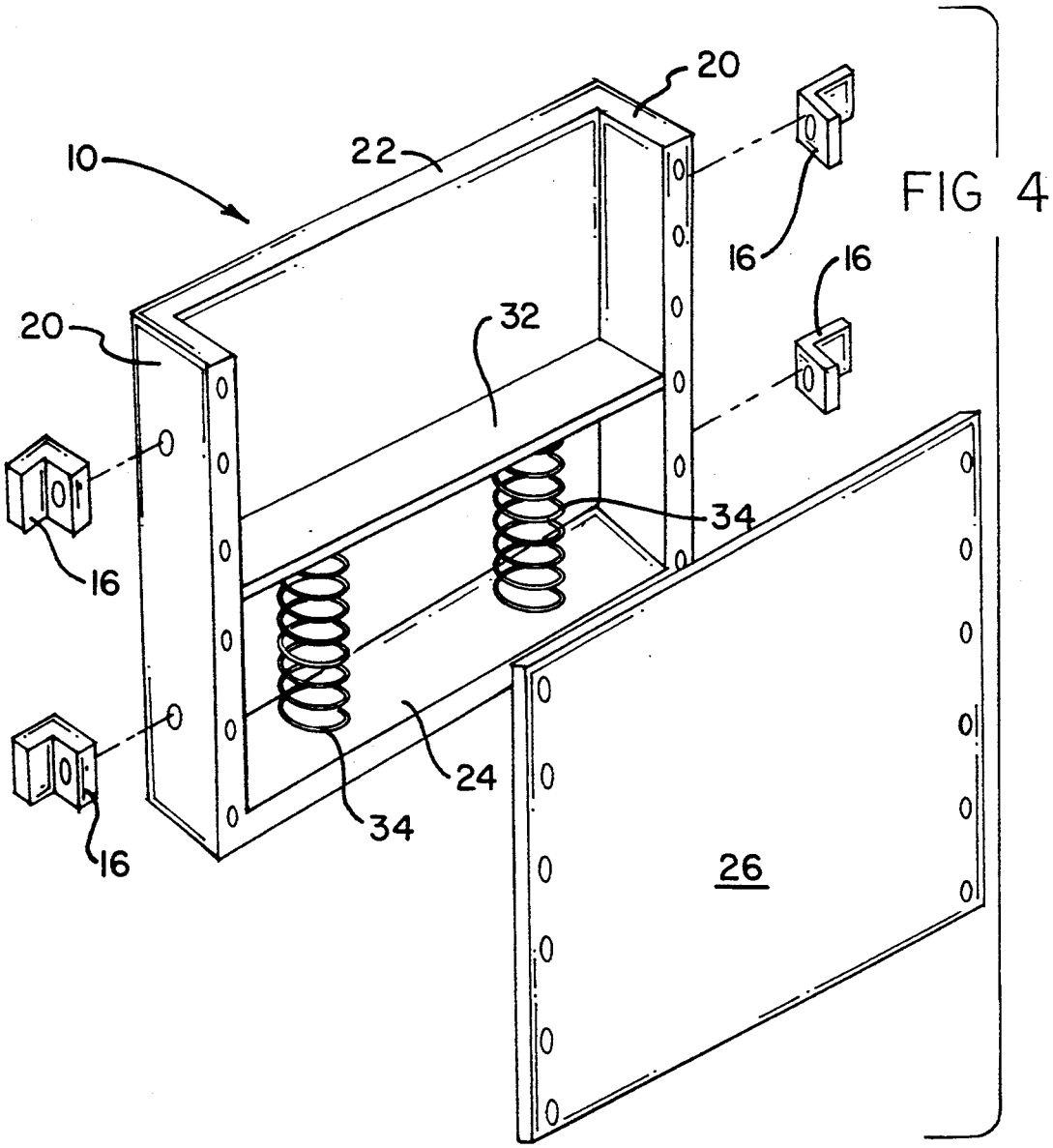
FIG. 4 is a perspective view, partially exploded, of the invention.

More specifically, it will be noted that the door mounted hamper 10 comprises a receptacle 12 having a pair of similarly shaped side walls 20 integrally or otherwise orthogonally connected to a back wall 22 in such a manner so as to lie in a parallel, spaced relationship to one another. Also integrally or otherwise orthogonally connected to both the back wall 22 and the side walls 20 is a bottom wall 24 which is best illustrated in FIG. 4. Completing the enclosure is a front panel 26 which is coupled the side walls 20 by suitable fastening means 28.

Figure 2:
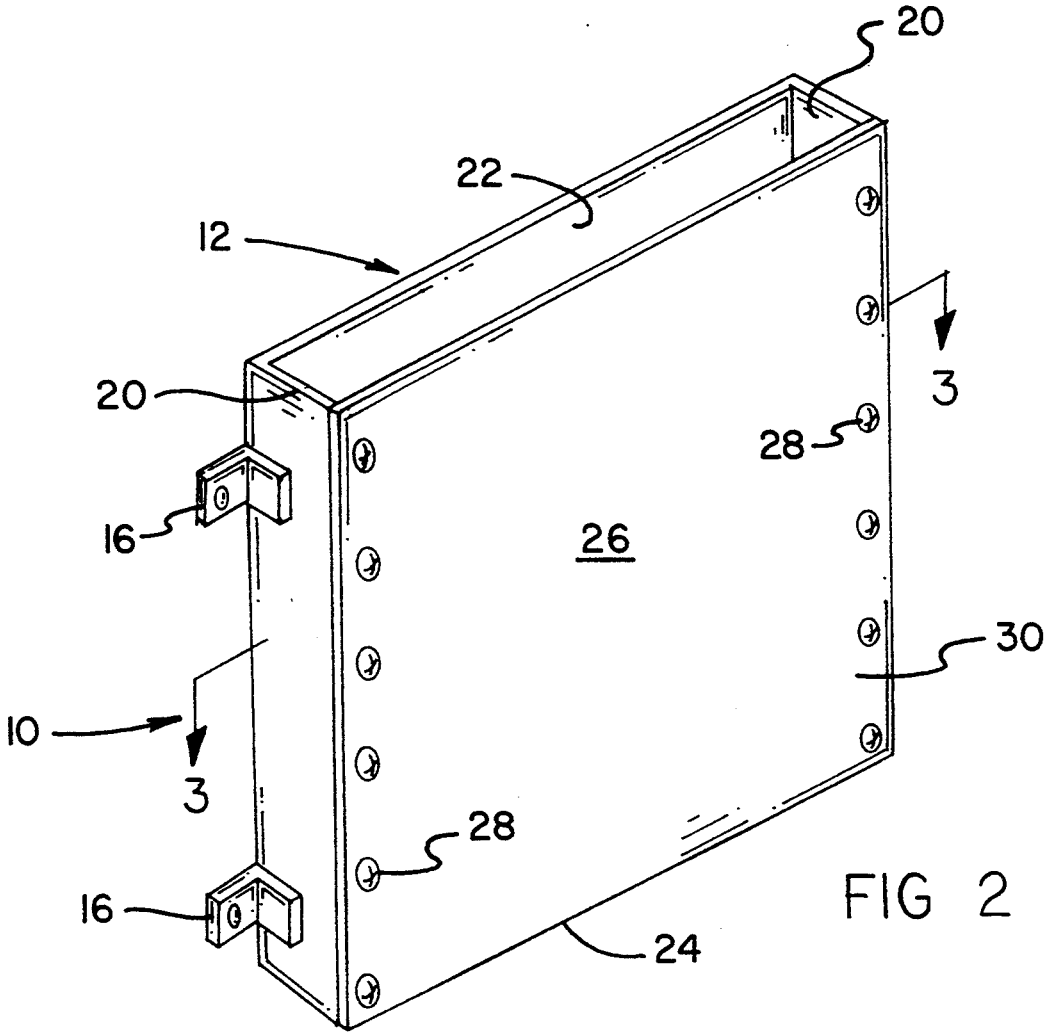
FIG. 2 is an enlarged perspective view of the present invention.
Figure 3:
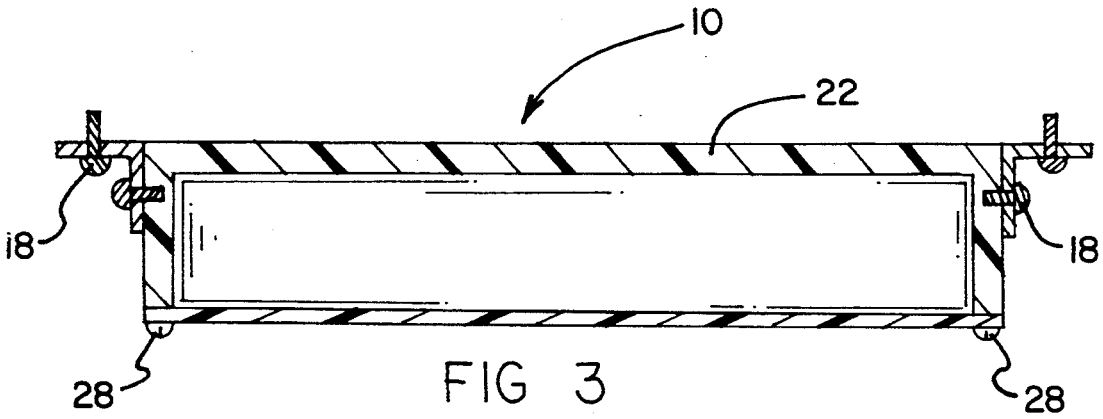
FIG. 3 is a cross sectional view taken along line 3—3 of FIG. 2.

In the first embodiment 10 of the door mounted hamper, the front panel 26 takes the form of a rigid panel 30 having a construction similar to that of the back wall 22. In addition, the first embodiment 10 utilizes conventional threaded fasteners for the fastening means 28 as best illustrated in FIG. 2.

The receptacle 12 may be conveniently mounted to the back side of a door 14 by a plurality of brackets 16 which attach to both of the side walls 20. Suitable attachment means include screws 18 illustrated in FIG. 3. The present invention utilizes four such brackets 16, with two brackets being attached to each of the side walls 20. However, it is within the intent and purview of the present invention to utilize any number of brackets 16, as well as other securing fixtures. Alternatively, the receptacle 12 may be secured to the door 14 by an engagement of the screws 18 through appropriate unillustrated apertures in the back wall 22 whereby the screws threadably engage the door 14 to secure the hamper 10 thereto in a well understood manner.

Additionally, the first embodiment of door mounted hamper may include a movable wall 32 positioned within the receptacle 12 and supported upon a pair of coil springs 34, as best illustrated in FIG. 4. The movable wall 32 is substantially rectangular and is dimensioned to fit in a horizontally extending position within the receptacle 12, as best illustrated in FIG. 4. The coil springs 34 supporting the movable wall 32 may be easily deformed such that a weight of the laundry positioned within the receptacle 12 will appropriately bias the movable wall towards the bottom wall 24 in a manner proportional to such weight. The spring supported movable wall 32 is operable to aid in the removal of laundry from the receptacle 12 by maintaining such laundry in an accessible position within the receptacle.

In use, the door mounted hamper 10 provides a convenient means for receiving and containing laundry which is inconspicuously mounted behind the door 14. Through this arrangement, the door mounted hamper 10 is effectively hidden behind the door when the door is in an open position.

Figure 5:
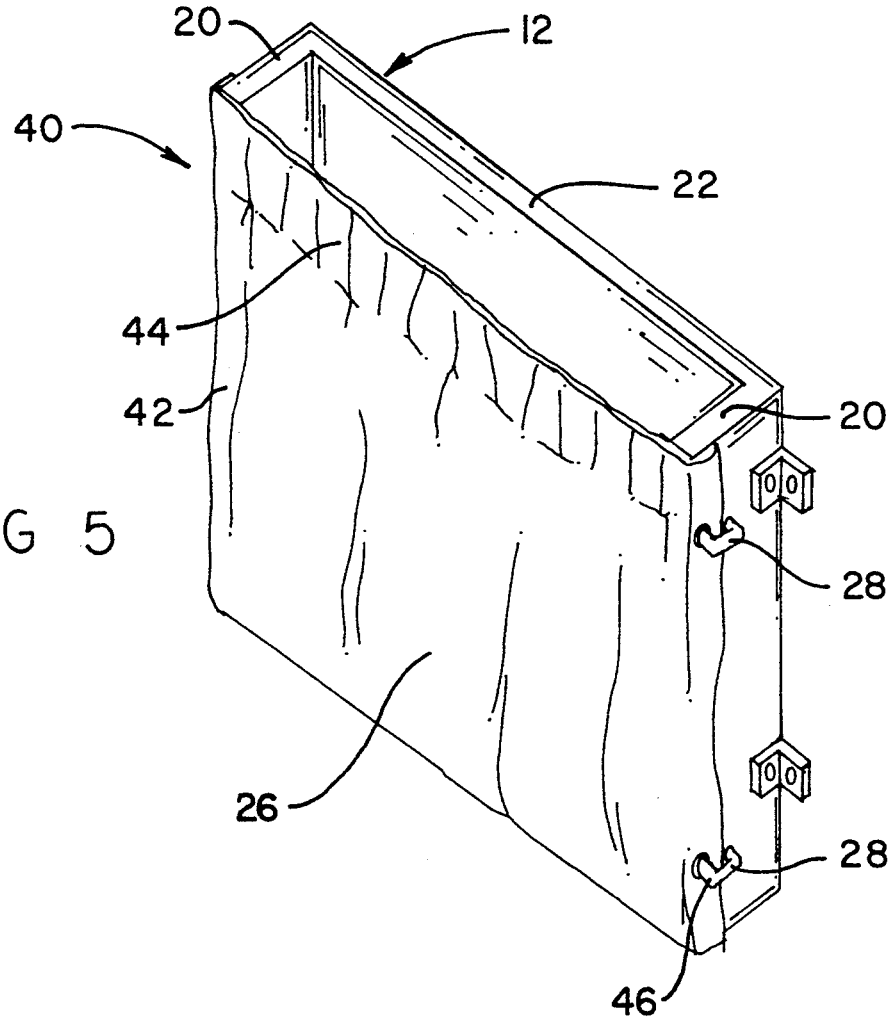
FIG. 5 is a perspective view of a second embodiment of a door mount hamper comprising the present invention.
Figure 6:
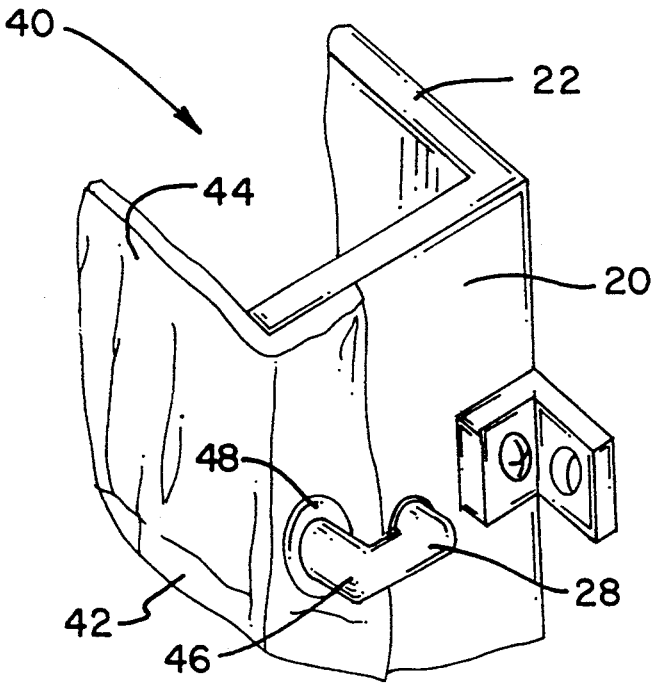
FIG. 6 is an enlarged perspective view of a portion of the second embodiment.

A second embodiment of the present invention as generally designated by the reference numeral 40, which comprises substantially all of the features of the foregoing embodiment 10 will now be described. As best shown in FIGS. 5–6, it can be shown that the second embodiment 40 includes the receptacle 12 defined by the pair of side walls 20 the back wall 22 the bottom wall 24 and the front panel 26. However, the second embodiment 40 differs from the first embodiment 10 in that the front panel 26 takes the form of a deformable fabric panel 42 having an elastic portion 44 at a top end thereof. In addition, the fastening means 28 of the second embodiment 40 comprise a plurality of hooks 46 which are pivotally mounted to the side walls 20 and the bottom wall 24. The hooks 46 are operable to project through a plurality of reinforced apertures 48 present around a periphery of the fabric panel 42 to secure the fabric panel to the side walls 20 and the bottom wall 24.

The second embodiment 40 of the door mounted hamper allows the receptacle 12 to accommodate a greater volume of laundry therewithin. In addition, the associated laundry may be easily removed from the second embodiment 40 by rotating any or all of the hooks 46 approximately 180 degrees and sliding the reinforced aperture 48 of the fabric panel 42 off of its associated hook, thereby facilitating ready access to the laundry contained within the receptacle 12.

Figure 7:
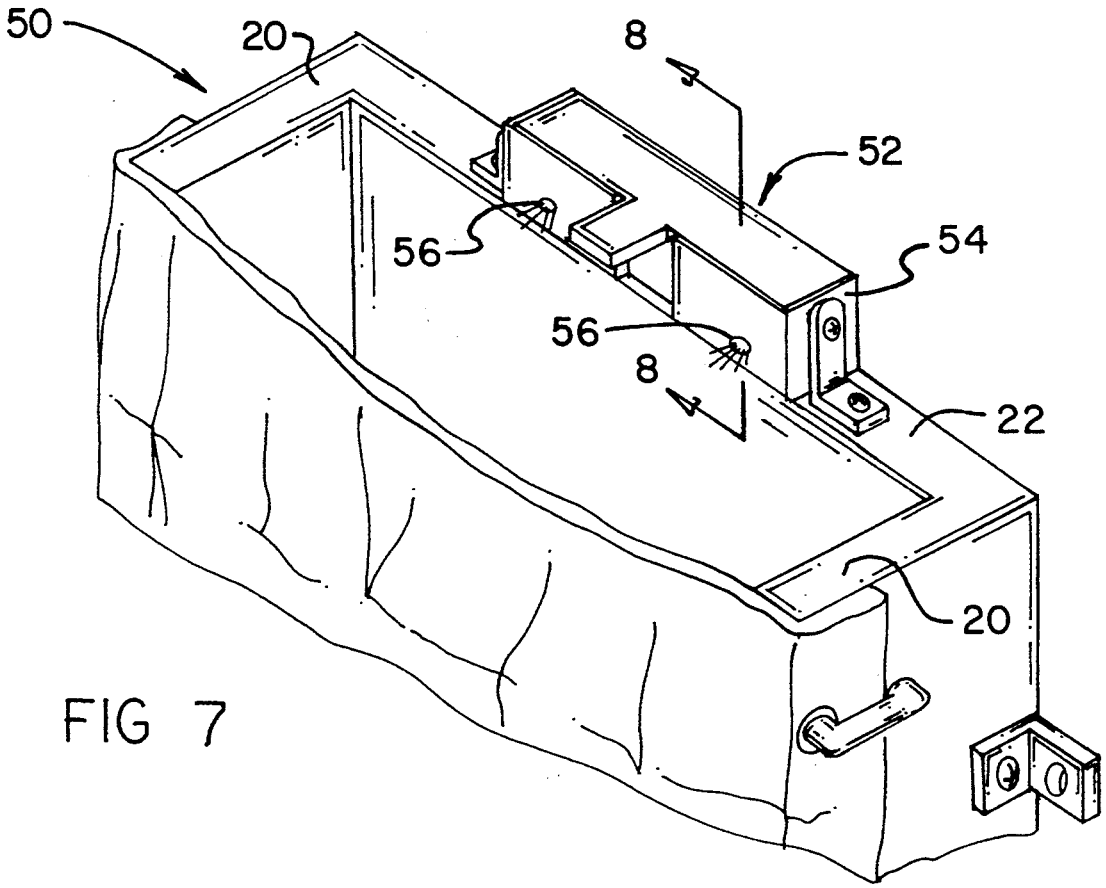
FIG. 7 is a perspective view of a portion of a third embodiment of a door mounted hamper comprising the present invention.
Figure 8:
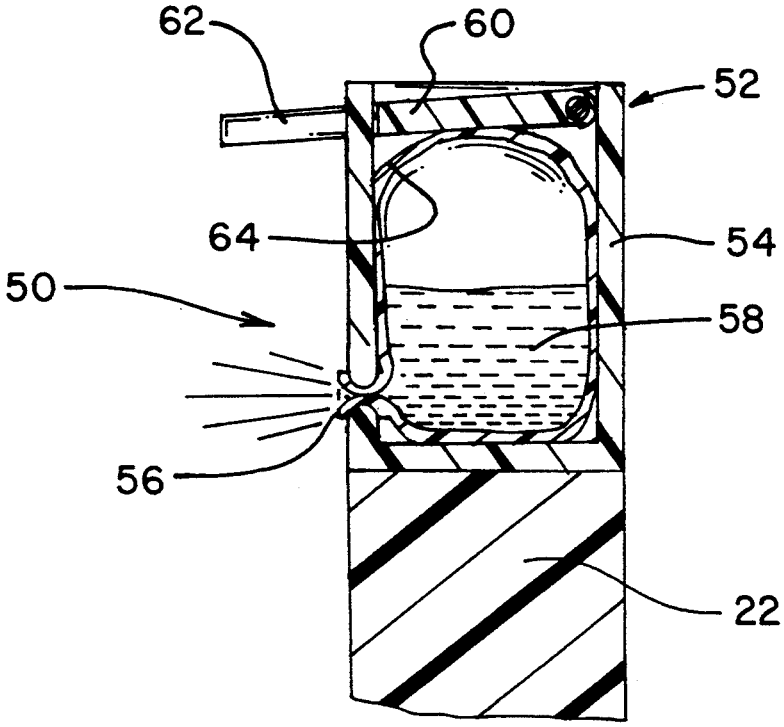
FIG. 8 is a cross sectional view taken along line 8—8 of FIG. 7.

Comprising substantially all of the features and structure of the foregoing embodiments 10, 40 is a third embodiment which is generally designated by the reference numeral 50 and may be viewed in FIGS. 7–8. It can be shown that the third embodiment 50 further comprises a deodorant dispenser 52 which may be fixedly secured to a top end of the back wall 22 by suitable bracketry and fasteners. The deodorant dispenser 52 comprises a dispenser body 54 having a substantially elongated, rectangular shape and defining a pair of nozzles 56 proximate respectively opposed ends thereof. The nozzles 56 are operable to dispense a sanitary fluid 58 onto the associated laundry positioned within the receptacle 12 by subsequently described structure.

As best illustrated in FIG. 8, a cover 60 is pivotally mounted to the dispenser body 54 and includes a cover handle 62 which may be utilized to manipulate the cover. Positioned within the dispenser body 54 and beneath the cover 60 is a flexible bladder 64 which may be filled with any fluid such as the sanitary fluid 58 mentioned above. Such fluid will then be dispensed through the nozzles 56 upon a depression of the cover 60 which effectively squeezes the bladder 64. The sanitary fluid effectively deodorizes the laundry contained within the receptacle 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A door mounted hamper for mounting to a vertical surface, said hamper comprising:

a receptacle having a pair of similarly shaped rigid side walls, a rigid back wall coupled to said side walls; a rigid bottom wall coupled to both said back wall and said side walls; and a rigid front panel coupled to said side walls, said receptacle having an open top end within which objects can be placed into an interior of said receptacle for storage;

a plurality of brackets, each of said brackets being secured to an exterior surface of said side walls and positioned for abutting engagement with said vertical surface;

a movable wall positioned within said interior of said receptacle between said side walls; and, at least one coil spring positioned within said interior of said receptacle and between an interior surface of said bottom wall and a lower surface of said movable wall such that said objects placed within said interior through said open top end of said receptacle will be supported upon said movable wall, said movable wall being movable relative to said receptacle in response to a weight of said objects wherein said plurality of brackets comprises a first pair of brackets secured to a first one of said side walls, and a second pair of brackets secured to a second one of said side walls.

2. The door mounted hamper of claim 1, wherein said at least one coil spring comprises a pair of spaced coil springs, each of said coil springs being positioned within said interior of said receptacle and between said interior surface of said bottom wall and said lower surface of said movable wall.

* * * * *